US006216578B1

(12) United States Patent
Ledys et al.

(10) Patent No.: US 6,216,578 B1
(45) Date of Patent: Apr. 17, 2001

(54) MUZZLE BRAKE FOR WEAPON BARREL

(75) Inventors: Francis Ledys, Villeneuve sur Cher; Jacques Bachelier, Plaimpied, both of (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 09/180,236

(22) PCT Filed: May 28, 1998

(86) PCT No.: PCT/FR98/01061

§ 371 Date: May 14, 1999

§ 102(e) Date: May 14, 1999

(87) PCT Pub. No.: WO98/54533

PCT Pub. Date: Dec. 3, 1998

(30) Foreign Application Priority Data

May 30, 1997 (FR) ..... 97 06704

(51) Int. Cl.[7] ..... F41A 21/36
(52) U.S. Cl. ..... 89/14.3
(58) Field of Search ..... 89/14.3, 14.2, 89/14.4, 14.6

(56) References Cited

U.S. PATENT DOCUMENTS

| | | | | |
|---|---|---|---|---|
| 817,134 | * | 4/1906 | Smith | 89/14.3 |
| 1,363,058 | | 12/1920 | Schneider | 89/14.3 |
| 1,854,974 | * | 4/1932 | Bernat | 89/14.3 |
| 2,567,826 | | 9/1951 | Prache | 89/14.3 |
| 3,368,453 | * | 2/1968 | Shaw | 89/14.3 |
| 3,492,912 | * | 2/1970 | Ashbrook | 89/14.3 |
| 5,036,747 | | 8/1991 | McClain, III | 89/14.3 |

FOREIGN PATENT DOCUMENTS

| | | | | |
|---|---|---|---|---|
| 244079 | * | 1/1947 | (CH) | 89/14.3 |
| 825614 | * | 3/1938 | (FR) | 89/14.3 |
| 825614 | | 9/1938 | (FR) | 89/14.3 |
| 911049 | * | 6/1946 | (FR) | 89/14.3 |
| 606478 | * | 8/1948 | (GB) | 89/14.3 |

* cited by examiner

*Primary Examiner*—Stephen M. Johnson
(74) *Attorney, Agent, or Firm*—Parkhurst & Wendel, L.L.P.

(57) ABSTRACT

A muzzle brake for a large caliber gun barrel incorporating at least two vents making the inside of the brake communicate with at least two vanes, receiving the gases, that are integral with the outside of the brake. The brake has at least one internal cylindrical support of the same caliber as the barrel and placed downstream of the vents according to the direction of movement of a projectile fired from the barrel. The internal cylindrical support is separated from the vent or vents that precede it by a concave surface of revolution whose concavity is oriented towards the rear of the brake.

5 Claims, 1 Drawing Sheet

MUZZLE BRAKE FOR WEAPON BARREL

FIELD OF THE INVENTION

The technical scope of the present invention is that of muzzle brakes for gun barrels, notably large caliber.

DESCRIPTION OF THE RELATED ART

A muzzle brake usually incorporates at least two transversal vents which make the inside of the brakes communicate with at least two vanes receiving the gases, such vanes being integral with the outside of the brake.

When a projectile is fired, the propellant gases are guided by the vents towards the vanes on which they exert a thrust thereby offsetting the gun barrel recoil.

Pat. U.S. Pat. No. 1,363,058 shows such a muzzle brake.

Muzzle brakes are commonly employed in the scope of field artillery, however, their use its reduced with respect to artillery equipping tanks or vehicles because of the disturbances they cause when arrow ammunition, or sub-calibred discardable-sabot projectiles, are being fired.

Indeed, any rifling of the barrel as well as the aerodynamic force exerted on such a projectile upon exiting the gun barrel causes the onset of the separation of the sabot and projectile inside the brake.

Such a separation deteriorates the brake and causes an angle of yaw which seriously disturbs its trajectory and prejudices firing accuracy.

To overcome such a drawback the diameter of passage for the projectile through the brake has been increased, but such a choice leads to a substantial reduction in the efficiency of the brake thereby increasing the stresses to which the tank or the barrel-carrying vehicle are subjected.

BRIEF SUMMARY OF THE INVENTION

The aim of the invention is to propose a muzzle brake that does not suffer from such drawbacks.

Thus, the muzzle brake according to the invention enables (whilst providing excellent efficiency) any initial disturbance of the projectile trajectory to be avoided as well as any deterioration of the inner surfaces of the brake.

Thus, the subject of the invention is a muzzle brake for a gun barrel, notably large caliber, and incorporating at least two vents making the inside of the brake communicate with at least two vanes receiving the gases that are integral with the outside of the brake, such brake having at least one internal cylindrical support of the same caliber as the barrel and placed downstream of the vents according to the direction of movement of a projectile fired from the barrel, wherein said internal cylindrical support is separated from said vent or vents that precede it by a concave surface of revolution whose concavity is oriented towards the rear of said brake.

According to a particular embodiment, said surface of revolution is a conical surface.

Advantageously, said surface of revolution extends longitudinally for a length of between 1.5 and 4 times the length of said cylindrical support.

The maximal diameter of said surface of revolution is preferably between 108% and 112% of the caliber D of the barrel.

According to a particular embodiment, said brake comprises at least two levels each formed by at least two vents and at least two vanes receiving the gases, the two consecutive levels being separated by a cylindrical support preceded by a surface of revolution.

BRIEF DESCRIPTION OF THE DRAWING

The invention will be better understood after reading the description that follows of a particular embodiment, such description made with reference to the appended drawing (FIG. 1) that shows a section of a muzzle brake according to the invention fastened to the end of a gun barrel.

DETAILED DESCRIPTION OF THE INVENTION

Figure 1:
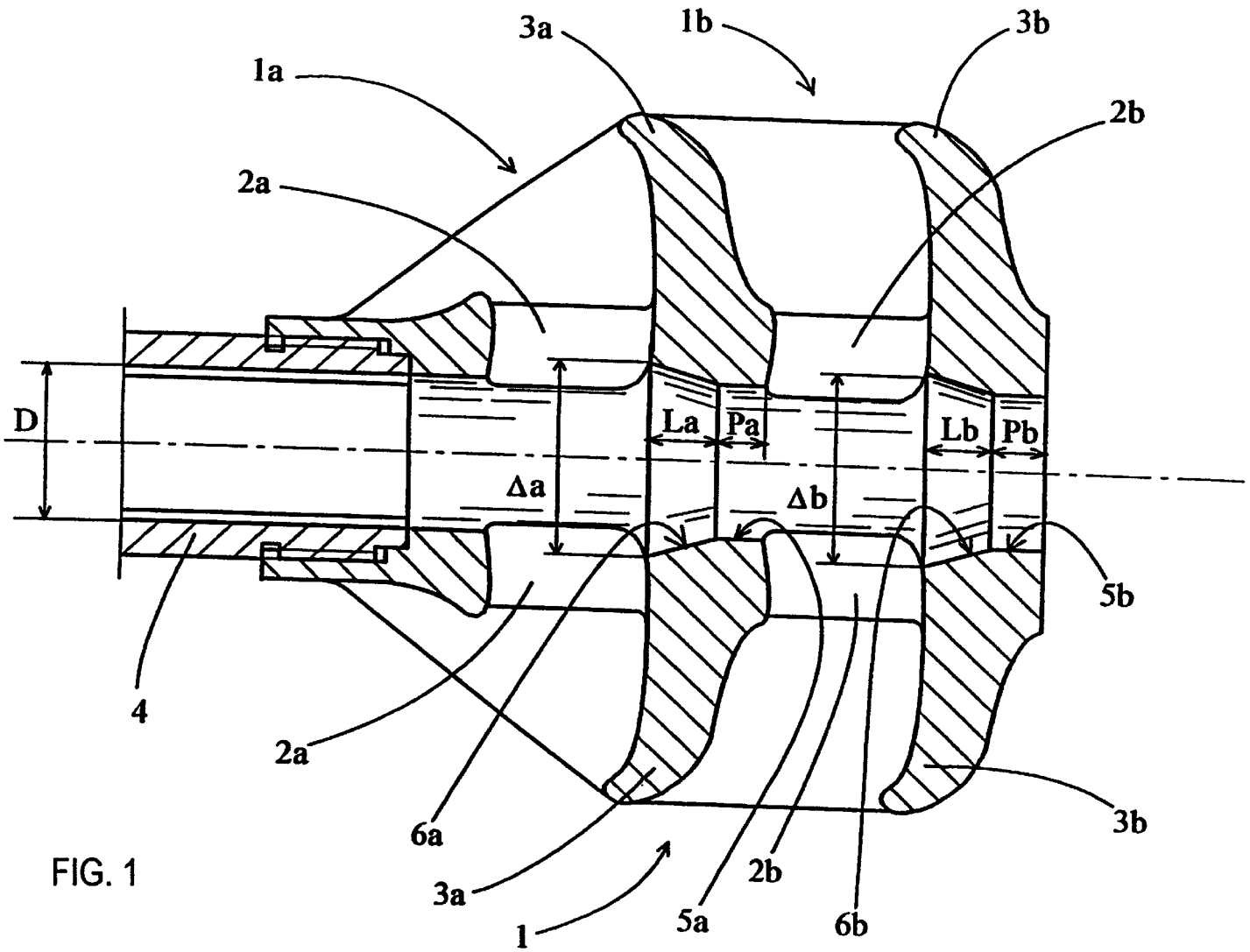

On FIG. 1, Muzzle brake 1 is in this example a brake that incorporates a first level 1*a* and a second level 1*b*.

Each level comprises two vents 2*a*, 2*b* and two vanes 3*a*, 3*b* receiving the gases.

Vents 2*a*, 2*b* make the inside of brake 1 communicate with the vanes that are integral with the outside of the brake.

The brake is fastened by threading to the end of a gun barrel 4, in this case a rifled barrel whose caliber (or diameter taken at the bottom of the grooves) is D.

The inside of the brake has two cylindrical supports 5*a*, 5*b* of the same caliber as the barrel. A first support 5*a* is placed downstream of the first vents 2*a* in the direction of movement of a projectile fired from the barrel. A second support 5*b* is located downstream of the second vents 2*b* and opens out to the outside of the brake.

The inner surface of the brake is, additionally, generally the same caliber D as the gun barrel, both level with the vents and with the cylindrical supports 5*a*, 5*b*.

In accordance with the invention, each support 5*a* or 5*b* is separated from the preceding vents by a conical surface of revolution 6*a* or 6*b* whose concavity is oriented towards the rear part of the brake intended to be fastened onto the gun.

Each conical surface extends longitudinally for a length (La or Lb) of between 60% and 80% of the length La+Pa or Lb+Pb of the vanes in question (Pa and Pb being respectively the lengths of cylindrical supports 5*a* and 5*b*). In other words, length La (or Lb) is between 1.5 and 4 times length Pa (or Pb).

The maximal diameter Δa or Δb of conical surface 6*a*, 6*b* is between 108% and 112% of caliber D of the barrel.

More generally, a maximal diameter Δa or Δb will be chosen such that the band of a discarding-sabot projectile is not able to fully come out of its housing on the sabot of the projectile.

Such dimensional arrangements enable the band to be reliably realigned in its positioning housing on the projectile.

Such a brake operates as follows:

When a sub-caliber discarding-sabot (not shown) projectile is fired, the projectile passes through muzzle 1. In a known manner, the propellant gases exit following the projectile from the vents and exert a thrust onto vanes 3*a*, 3*b*. This thrust offsets part of the gun recoil.

The aerodynamic forces exerted on the projectile, as well as the centrifugal force (due to the rifling) result in the initiation of an opening movement of the projectile sabot. The gases are also exerted on the band and result in said band being dislodged from the sabot.

The projectile band is thus subjected to an extension strain and its begins to be dislodged from its sabot housing.

Even though the inner diameter of the brake is of the same caliber as the barrel level with the vents, the band deforms upon reaching them.

Conical surfaces 6*a* and 6*b* will then, each in turn, come into contact with the projectile band and will guide it so as to reposition it in its sabot housing.

Cylindrical supports 5*a* and 5*b* of the same caliber as the gun will then ensure the guidance of the projectile which exits the barrel with neither disturbance nor yaw.

Thus, thanks to the invention, the projectile band is prevented from receiving shocks from cylindrical supports 5*a*, 5*b* of the brake. The band is held in place by the supports and it remains in its sabot housing until the projectile exits the muzzle brake.

This results in a projectile firing without yaw and with better accuracy. The efficiency of such a muzzle brake is excellent (around 55%) as it incorporates vents having a wide section combined with wide vanes. Yet it does not disturb the trajectory of sub-calibred projectiles as it ensures the repositioning of the bands.

The projectile can thus be guided without shocks through the brake and this with relatively reduced (15% of the total length travelled by the projectile in the muzzle brake) guidance support lengths.

By way of a variant, it is naturally possible for each conical surface to be replaced by a concave surface of revolution whose concavity will be oriented towards the rear of the brake.

What is claimed is:

1. In combination, a muzzle brake and a gun barrel, said combination comprising: a gun barrel; a muzzle brake attached to the gun barrel; at least two vents making the inside of the brake communicate with at least two vanes receiving the gases that are integral with the outside of the brake, said brake having at least one internal cylindrical support of the same caliber (D) as the barrel and placed downstream of the vents according to the direction of movement of a projectile fired from the barrel, characterized in that (1) the inner surface of the brake is generally the same caliber (D) as the gun barrel, level with the cylindrical supports, and (2) the internal cylindrical support is separated from said vent or vents that precede the cylindrical support by a concave surface of revolution whose concavity is oriented towards the rear of the brake; and is a conical surface, and extends longitudinally for a length (La, Lb) of between 1.5 and 4 times the length (Pa, Pb) of the cylindrical support.

2. A combination according to claim 1, characterized in that the maximal diameter (Δa, Δb) of said surface of revolution is between 108% and 112% of the caliber (D) of the barrel.

3. A combination according to claim 2, characterized in that the muzzle brake comprises at least two consecutive levels, each level formed by a pairing of at least two vents with at least two vanes receiving the gases, wherein the two consecutive levels are separated by a cylindrical support preceded by a surface of revolution.

4. In combination, a muzzle brake and a gun barrel, said combination comprising:

a gun barrel; and a muzzle brake attached to the gun barrel, the brake comprising at least two vents making the inside of the brake communicate with at least two vanes that are integral with the outside of the brake, said brake having at least one internal cylindrical support of the same caliber (D) as the barrel and placed downstream of the vents according to the direction of movement of a projectile fired from the barrel, wherein (1) the inner surface of the brake is generally the same caliber (D) as the gun barrel and level with the cylindrical supports, and (2) the internal cylindrical support is separated from said vent or vents that precede the cylindrical support by a concave surface of revolution whose concavity is oriented towards the rear of the brake, said concave surface is a conical surface having a maximal diameter (Δa, Δb) between 108% and 112% of the caliber of the barrel.

5. The combination of claim 4, wherein the muzzle brake has at least two consecutive levels, each level formed by a pairing of at least two vents with at least two vanes receiving the gases, wherein the at least two consecutive levels are separated by a cylindrical support preceded by a surface of revolution.

* * * * *